US005865943A

United States Patent [19]

Marty

[11] Patent Number: 5,865,943

[45] **Date of Patent: *Feb. 2, 1999**

[54] APPARATUS FOR APPLYING ADHESIVE PRODUCT TO ROAD BARRIERS

[75] Inventor: John L. Marty, St. Paul, Minn.

[73] Assignee: Minnesota Mining and Manufacturing Company, St. Paul, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 882,713

[22] Filed: Jun. 25, 1997

[51] Int. Cl.[6] ..... B44C 1/10

[52] U.S. Cl. ..... 156/577; 156/574; 242/557; 256/13.1; 404/6

[58] Field of Search ..... 156/574, 577; 52/717.03; 242/557, 588.2, 592; 256/13.1; 404/6

[56] References Cited

U.S. PATENT DOCUMENTS

| | | | |
|---|---|---|---|
| 696,672 | 4/1902 | Glickman | 156/575 |
| 1,901,908 | 3/1933 | Hoyos | 156/577 X |
| 3,007,838 | 11/1961 | Eigenmann | 156/526 |
| 3,279,336 | 10/1966 | Eaton et al. | 94/44 |
| 3,393,114 | 7/1968 | Jorgensen | 156/523 |
| 3,393,615 | 7/1968 | Micheln | 94/39 |
| 3,551,251 | 12/1970 | Sato et al. | 156/384 |
| 3,864,052 | 2/1975 | Blomberg | 404/94 |
| 3,871,940 | 3/1975 | Antonioni | 156/353 |
| 3,874,801 | 4/1975 | White | 401/2 |
| 3,886,011 | 5/1975 | Eigenmann | 156/71 |
| 4,000,882 | 1/1977 | Penton | 256/13.1 |
| 4,030,958 | 6/1977 | Stenemann | 156/350 |
| 4,242,173 | 12/1980 | Stenemann | 156/523 |
| 4,369,614 | 1/1983 | Tetzner | 242/557 X |
| 4,623,280 | 11/1986 | Stenemann | 404/94 |
| 4,824,516 | 4/1989 | Ishihara et al. | 156/577 X |
| 4,923,559 | 5/1990 | Kennedy et al. | 156/523 |
| 4,974,990 | 12/1990 | Anderson et al. | 404/94 |
| 5,042,221 | 8/1991 | Pacione | 156/575 X |
| 5,059,061 | 10/1991 | Stenemann et al. | 404/72 |
| 5,127,164 | 7/1992 | Belcourt et al. | 156/577 X |
| 5,628,867 | 5/1997 | Renaud | 156/577 X |
| 5,667,165 | 9/1997 | Gardner | 242/588.2 X |
| 5,685,054 | 11/1997 | Yasnogorodskiy et al. | 242/557 X |

FOREIGN PATENT DOCUMENTS

| | | | |
|---|---|---|---|
| 0 507 714 | 7/1992 | European Pat. Off. | E01C 23/16 |

OTHER PUBLICATIONS

Page entitled "D. Scotchliner Roller Tamper Cart (RTC–2)"; p. 59.

Page entitled "Jungle Wheels™"; Jungle Jims's Accessory Products, Inc., one page.

U.S. Trademark "Scotch–Lane"; Principal Register No. 826, 285, Registered Mar. 28, 1967 (one page).

Catalog page—"Material Handling—Lane Marker/Tape Applicator and Reflective Warning Tape"; Wholesale Prices—Grainger; p. 1794.

Catalog page—"Safety Marking Tapes"; Master–Carr, p. 875.

Information Folder 1000—"Scotchliner" Brand Manual Highway Tape Applicator; 3M; Apr., 1983; 1 page.

*Primary Examiner*—Mark A. Osele
*Attorney, Agent, or Firm*—Peter L. Olson

[57] ABSTRACT

A tape applying apparatus for applying adhesive tape product to a primarily vertical surface includes a taping head which can be adjusted to apply the tape product at a specific predetermined location along such a primarily vertical surface, wherein the taping head is mounted to follow surface fluctuations. Moreover, the taping head is preferably vertically adjustable, horizontally movable, and angularly repositionable. Thus, adhesive tape product can be applied consistently and for an indefinite length based on preset positions, and the taping head is movable to follow surface changes or undulations.

20 Claims, 12 Drawing Sheets

APPARATUS FOR APPLYING ADHESIVE PRODUCT TO ROAD BARRIERS

TECHNICAL FIELD

The present invention is directed to an apparatus for applying adhesive tape product to primarily vertical surfaces, such as the side surfaces of road barriers. More specifically, the present invention is directed to such an applicator including a taping head for applying the adhesive tape product which is adjustable in various ways so that the tape product can be accurately and continuously applied to a primarily vertical surface over an indefinite length.

BACKGROUND THE INVENTION

The present invention has been developed for its particular applicability to the application of retroreflective adhesive tape product to road barriers, such as those known as"Jersey" barriers. These road barriers typically include vertical or nearly vertical side surfaces, and are arranged end to end to make a road barrier having vertical side wall surfaces that extend for an indefinite length.

For improved visibility of the barrier, particularly at night, it is often desirable to apply a horizontally running stripe of retroreflective material along its vertical sidewalls. Such retroreflective material may be applied to a series of barriers as discrete lengths of material, or may comprise a horizontally running continuous strip of indefinite length.

In either case, the application of retroreflective material provided in the form of an adhesive tape product has been fairly labor intensive. This is especially true in the case of applying a continuous adhesive tape product over a number of barriers positioned end to end for an indefinite length. The sidewalls of the barriers typically do not match up perfectly, so at the barrier interfaces, compensation must be made for the undulations between the adjacent surfaces. In any case, the adhesive tape product must be adequately secured to the barrier sidewall by the even application of sufficient pressure over the length of the adhesive tape product that is applied. It is also desirable that the retroreflective tape be applied at a consistent and predetermined height based on a number of factors in order to achieve the desired visibility. Thus, care must be taken to apply such a retroreflective adhesive tape product in a specific predetermined manner.

Heretofore, retroreflective adhesive tape product has been applied to the sidewalls of road barriers by a manual labor intensive process. The basic steps include cleaning the sidewall surface of the barrier; measuring and marking where the adhesive tape product is to be applied to the barrier; applying a primer to the barrier for improved adhesion; applying the adhesive tape product to the barrier in accordance with its marked position; and applying even pressure over the adhesive tape product, such as by a hand held roller, to improve the adhesion between the tape product and the barrier. Not only is the application process itself labor intensive, but this type of process also limits the size and weight of the tape provided in roll form which can be handled effectively by an operator. Moreover, such adhesive tape product is typically provided on a liner, thereby requiring the operator to also strip the liner material from the tape during the application process.

Tape applicator devices including operator controlled taping heads of many varieties have been developed for specific types of application processes. Moreover, it is known to apply many different types of tapes with taping heads both manually and automatically. Automatic operations normally involve the provision of stationary equipment that includes a taping head through which product can be run so that tape is applied thereto. Examples include the application of adhesive tapes to continuous and/or indefinite web lengths, or the discrete application of tape segments to a series of individual specific products. Manual tape applicators are often used in situations requiring more operator control. That is, where the operator decides where to position the tape and how much tape to dispense. Examples include applicators designed for work in the field or on very large objects.

Automatic machines, however, have been developed in the area of applying retroreflective adhesive tape product for the application of road stripes to pavement. Developments have been made in both continuous and the discrete application of such retroreflective adhesive tape product. Examples include a push-type mechanical device disclosed in U.S. Pat. No. 4,242,173 to Steneman on Dec. 30, 1980, and a Self-Propelled Pavement Marking Tape Applicator disclosed in copending and commonly owned U.S. patent application Ser. No. 08/704,196, filed Aug. 28, 1996. In these type devices, retroreflective adhesive tape product is applied to a substantially horizontal surface.

SUMMARY OF THE PRESENT INVENTION

The present invention overcomes the disadvantages and shortcomings of the prior art by an apparatus which can be used for applying adhesive tape product to a primarily vertical surface which is much less labor intensive and which efficiently and accurately applies the adhesive product over an indefinite length. A primarily vertical surface is one which is more vertical than horizontal. The tape product can be applied as a continuous length or as discrete lengths.

More specifically, the present invention is directed to an apparatus including a taping head for fully applying an adhesive tape product against a primarily vertical surface, and which can be adjusted to apply the tape product at a specific predetermined location along such a surface and wherein the taping head is mounted so that it can follow surface undulations. Preferably, the taping head is vertically positionable, horizontally movable, and angularly adjustable. The tape applicator of the present invention is advantageous in that it eliminates the need to measure and mark the surface to which the tape product is to be applied. Once the apparatus of the present invention is set for a particular application, tape product can be effectively and consistently applied over an indefinite length. In particular, the tape head angle and height need be adjusted only initially so that the tape product can thereafter be applied consistently for an indefinite length. Also by the present invention, surface changes or undulations are accommodated for by horizontally movable and tiltable mechanisms.

In the case of applying a retroreflective adhesive tape product to road barriers, as discussed above, the necessity for an operator to manipulate cumbersome tape rolls during application is also eliminated. Even in the case of a linered adhesive tape product, the present invention eliminates the need for an operator to hand strip the liner from the adhesive tape product prior to application and eliminates the need to handle the removed liner material after application.

The aforementioned advantages are achieved by an apparatus for applying adhesive tape product to a primarily vertical surface of an object over an indefinite length, wherein the apparatus includes a taping head, a frame which is movable along the object to which the adhesive tape product is to be applied by the taping head, and a tilt mechanism operatively connected between the frame and the taping head for permitting an axis of rotation of the application roller to be oriented in different angular positions relative to vertical so that the adhesive tape product can be dispensed and applied by the taping head to a primarily vertical surface during movement of the frame relative to the object.

Preferably, the apparatus further includes a movable member disposed relative to the frame and connected to the taping head so that the application roller of the taping head is positionable toward or away from the primarily vertical surface of the object. The movable member is also preferably further connected to the frame by a height adjustment mechanism so that the taping head can also be adjusted between various height positions. The movable member can comprise a part of a horizontal frame assembly, preferably mounted between the height adjustment mechanism and the tilt mechanism. A four-bar linkage is preferred as the horizontal frame assembly with a spring biasing means for urging the movable member toward an outermost position. The height adjustment mechanism further preferably comprises a guiding system.

In accordance with another aspect of the present invention, the apparatus for applying adhesive tape product to a primarily vertical surface over an indefinite length is characterized by a taping head having an application roller, a frame which is movable along an object to which adhesive tape product is to be applied, and a movable member disposed on the frame and operatively connected to the taping head so that the application roller of the taping head is positionable toward or away from the primarily vertical surface of an object without moving the frame. Preferably, this apparatus further comprises a tilt mechanism between the frame and the taping head for permitting the axis of rotation of the application roller to be repositionable relative to vertical, as well as a height adjustment mechanism between the movable member and the frame.

DETAILED DESCRIPTION OF THE PREFERRED EMBODIMENTS

Figure 1:
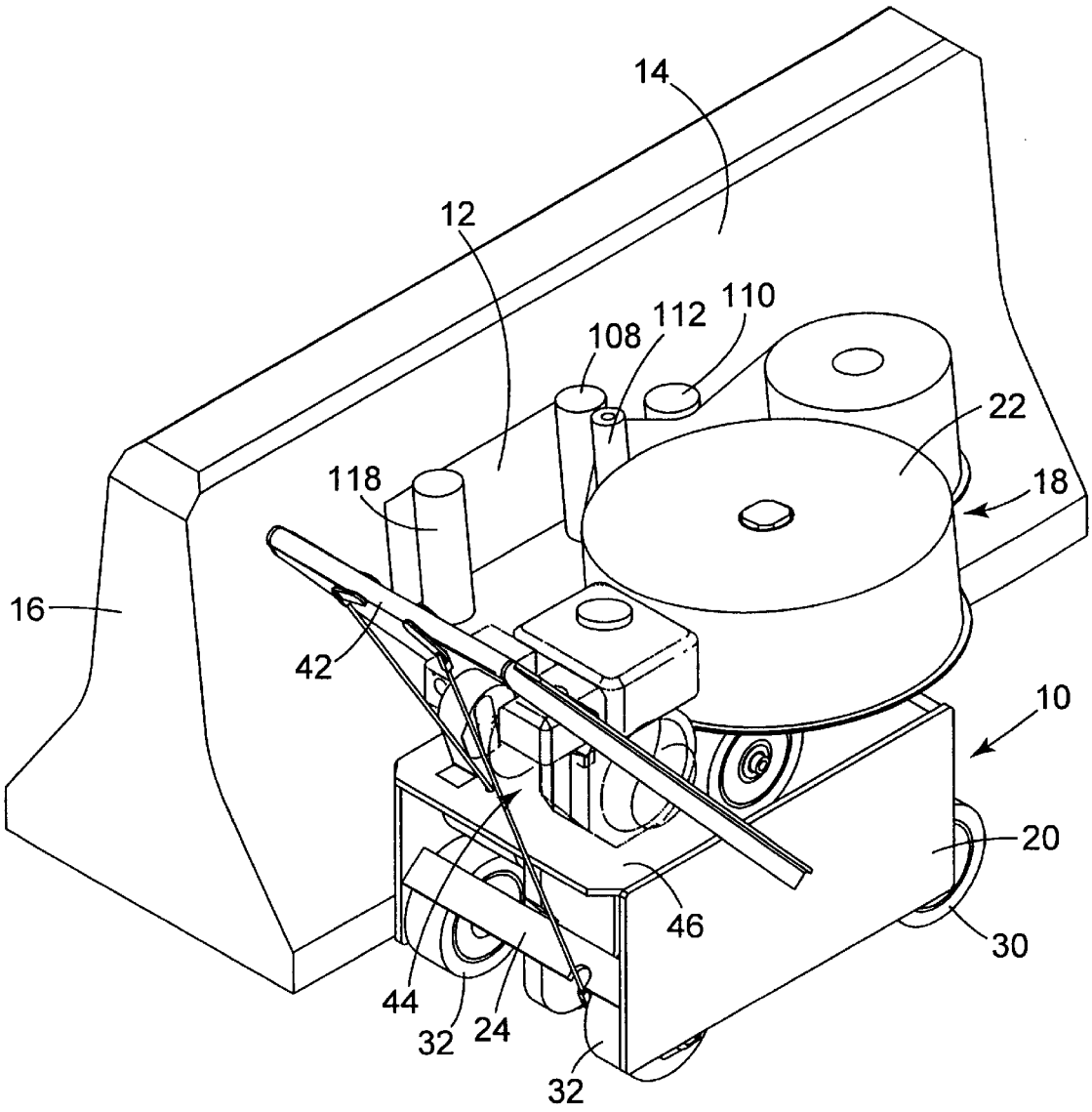
FIG. 1 is a perspective view of an adhesive tape applying apparatus in accordance with the present invention including a schematic illustration of a taping head in the process of applying an adhesive tape product to a primarily vertical sidewall of a road barrier.
Figure 2:
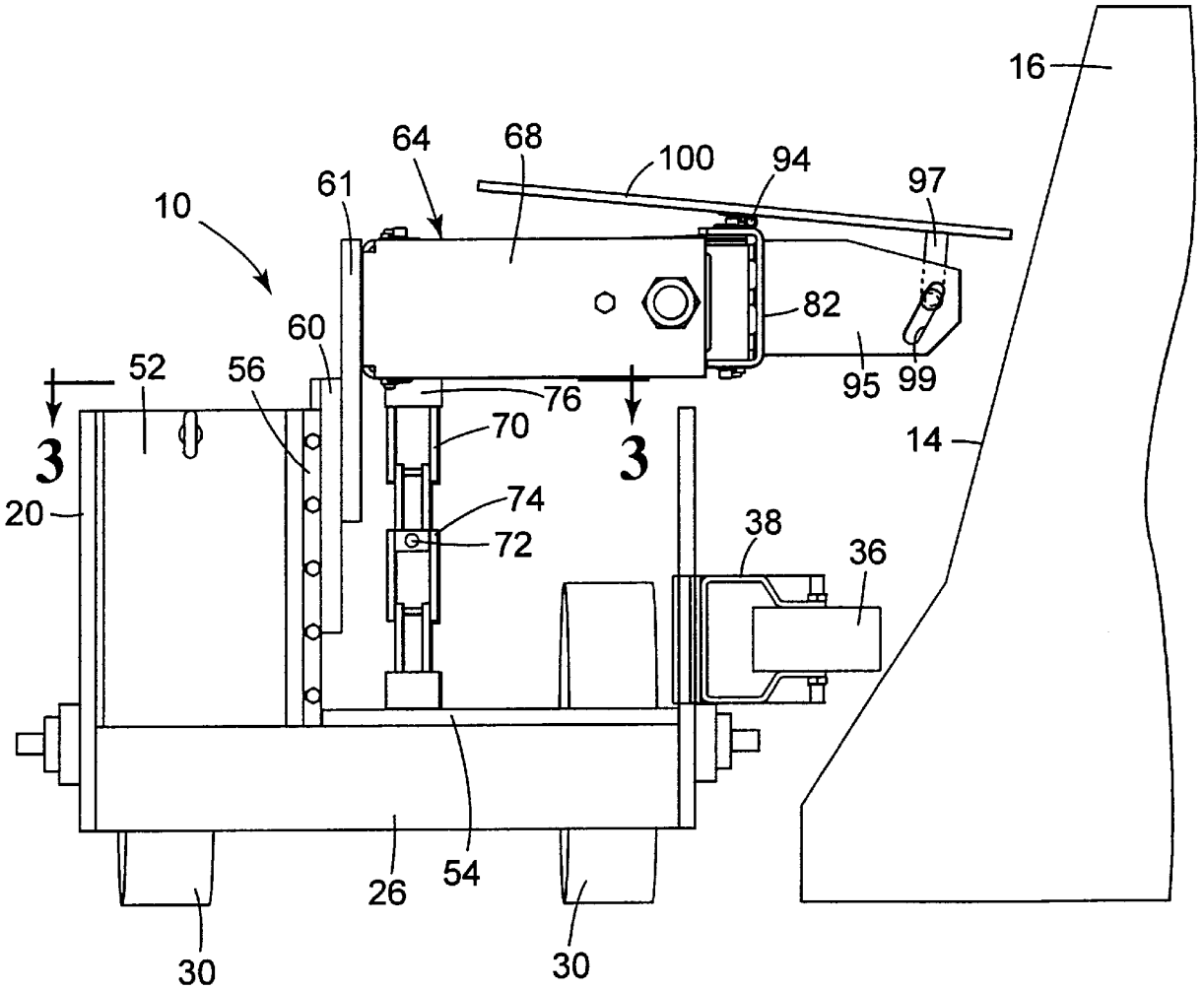
FIG. 2 is a front view of the adhesive tape applying apparatus of FIG. 1 shown in the process of applying the adhesive tape product to a road barrier and illustrating a vertical adjustment mechanism for positioning the taping head.

With reference now to the Figures, wherein like components are designated with like numerals throughout the several Figures, and initially to FIGS. 1 and 2, an adhesive tape applying apparatus 10 is illustrated for dispensing and applying an adhesive tape product 12 against a primarily vertical surface. A primarily vertical surface is meant to be a surface that is more vertical than horizontal. Specifically, the present invention has been developed for its particular applicability to apply a retroreflective adhesive tape product as product 12 onto a sidewall 14 of a road barrier 16.

Road barriers 16 are conventionally known for use in many roadway situations including permanent barriers as well as temporary barriers, such as in construction areas. Typically, the barriers 16 are aligned end to end with one another to define a continuous barrier of indefinite length. In any case, it is sometimes desirable to increase the visibility of the barriers 16, particularly at night. To increase the visibility, one method is to apply retroreflective material to an appropriate surface or surfaces along the indefinite length of the continuous barrier. The retroreflective material may be applied as a continuous stripe of indefinite length or may be applied as discrete lengths in a regular or irregular pattern. The desired position of the retroreflective material on the barrier is determined on many factors, the purpose of which is to increase visibility. Typically, the basic application process includes adhering a retroreflective adhesive tape product 12 to the sidewall portions 14 of the arrangement of the road barriers 16. Moreover, the adhesive tape product 12 is preferably applied over the same indefinite length as the accumulated length of the barriers 16. In other words, it is preferable that the adhesive tape product 12 be applied in a continuous manner to follow the length of the barriers 16.

However, when the barriers 16 are arranged and end, there likely will be surface undulations as a result of misalignment, road surface variations, or dimensional differences of the barriers 16. By the present invention, the adhesive tape product 12 can be applied to a continuous surface over an indefinite length, including the ability to apply the adhesive tape product 12 while compensating for any such surface undulations. Specific processes for applying adhesive tape product 12 will be discussed in more detail below.

It is further understood that the present invention is usable for the dispensing and applying of adhesive tape products to many other vertical or primarily vertical surfaces. Use of the present invention is particularly advantageous in those applications where an adhesive tape product is to be applied to a primarily vertical surface over a long, continuous and indefinite length.

As shown in FIGS. 1 and 2, the adhesive applying apparatus 10 basically comprises a taping head 18 mounted atop a cart assembly 20. The taping head 18 supports a roll 22 of adhesive tape product 12 which is to be applied to the sidewall 14 of a road barrier 16, for example. The cart 20 includes supporting mechanisms for positioning the taping head 18 in accordance with a predetermined height, horizontal location and tilt angle as will be specifically described below.

Figure 3:
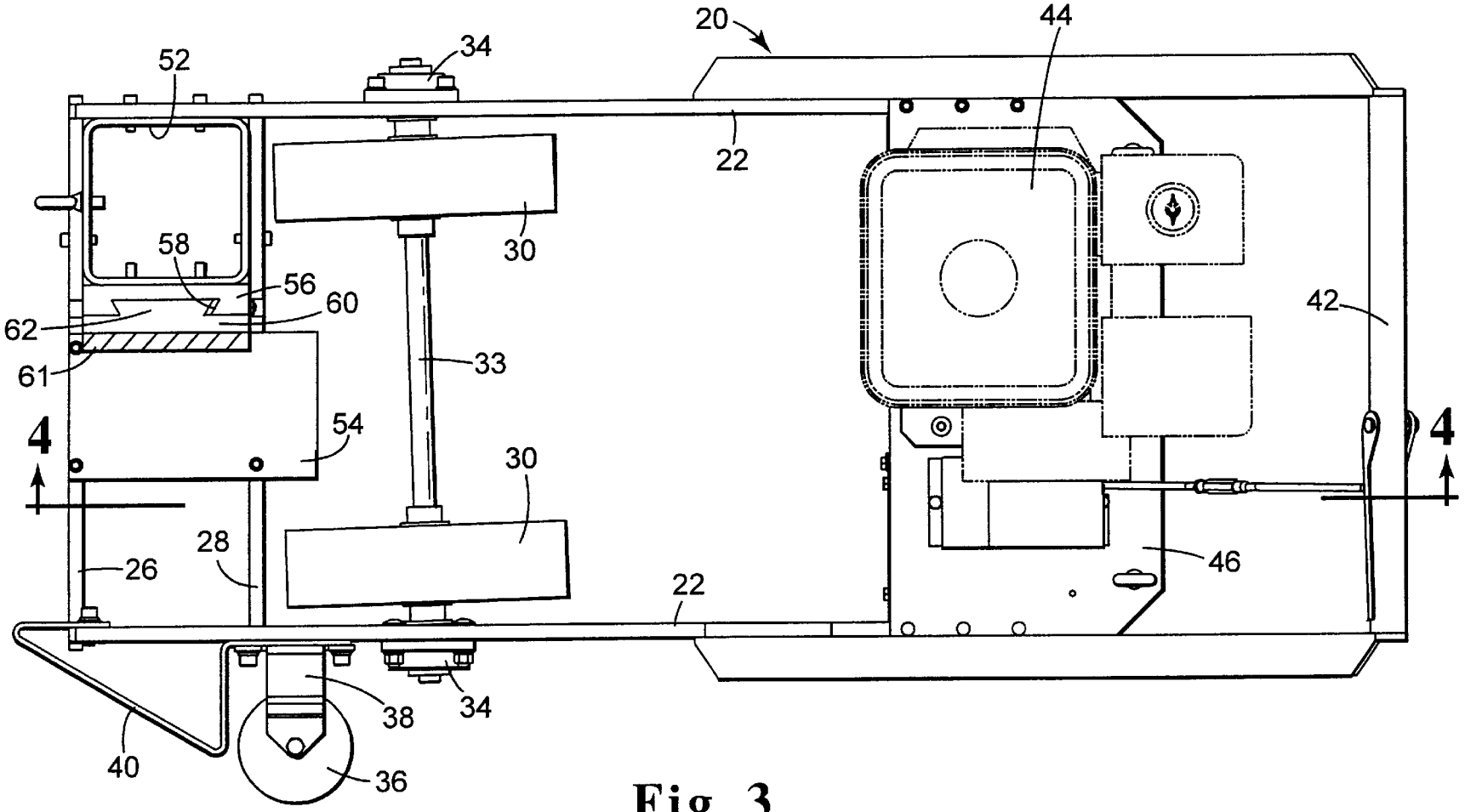
FIG. 3 is a partial cross-sectional view taken through line 3—3 of FIG. 2 showing a top view of a cart assembly of the adhesive tape applying apparatus beneath the taping head and its support plate and with the vertical adjustment mechanism removed.
Figure 4:
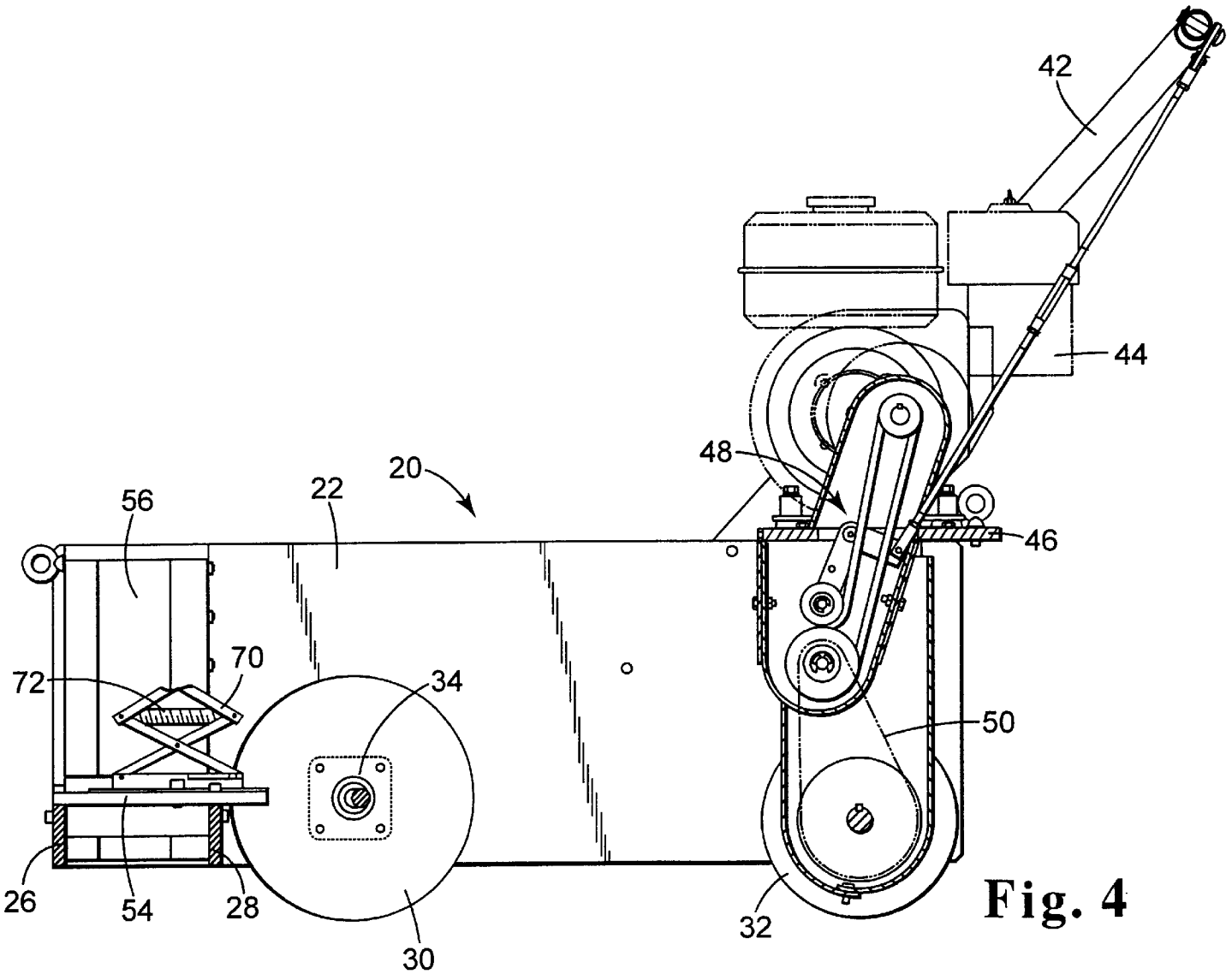
FIG. 4 is a cross-sectional view taken along line 4—4 in FIG. 3.

As shown best in FIGS. 3 and 4, the cart 20 comprises a support frame including spaced sidewalls 22 which are connected together at the rear by a frame element 24 (see FIG. 1) and at the front end by a pair of frame elements 26 and 28. The cart assembly 20 preferably also supports front and rear wheels 30 and 32 respectively, so that the entire cart assembly 20 is easily mobile. In accordance with the present invention, the cart 20 serves to permit the taping head 18 to be moved along a primarily vertical surface.

More preferably, a pair of front wheels 30 are provided on an axle 33 which is supported by the sidewalls 22 of the cart assembly 20 through bearing assemblies 34. A bearing assembly 34 on one side of the cart 20 (the top as shown in FIG. 3) is preferably advanced more toward the front side of the cart assembly 20 than the bearing 34 on the other sidewall 22 so that the wheels 30 are slightly angled toward one side. As a result, the cart 20 will tend to move toward the applying side of the cart 20 (defined by the taping head 18) during its forward motion so as to follow the application surface of the object to which adhesive tape product 12 is to be applied. The bearings 34 can comprise conventional bearings, such as Fafnir Cartridge bearings RCJC-3/4, available from the Fafnir Bearing Company of New Britain, Connecticut, which permit the axle 33 to pass through at an angle.

Moreover, in order to assist in the guidance of the cart 20 along an object to which the adhesive tape product 12 is to be applied, a further guide roller 36 is freely pivotally mounted to the one sidewall 22 on the applying side of the cart 20, such as by a bracket at 38. The guide roller 36 can be positioned at any predetermined location, such as shown in FIG. 2 in order to follow a specific surface of the object to which the adhesive tape product 12 is to be applied. In the case of barriers 16, a lower outward surface of the barriers 16 is preferred. The roller 36 may instead be mounted on an adjustable mount. Furthermore, for assisting in the alignment of the cart 20 with respect to an object, a cam bracket 40 is also preferably provided just before the guide roller 36. The cam bracket 40 also comes into assistance where a plurality of objects, such as road barriers 16, are aligned end to end and where one is more substantially offset with respect to another.

The cart 20 is also preferably provided with a guide and control handle 42 (see FIGS. 1 and 4) allowing an operator to position and control the operation of the apparatus 10. In accordance with a preferred apparatus 10, an engine 44 is preferably provided for driving the rear wheels 32. The engine 44 can be of any conventional variety, but preferably comprises a variable speed internal combustion engine, such as a 5.5 horsepower model no. GX160-K1HX2, available from American Honda Motor Company of Duluth, Ga. As shown, the engine 44 is supported on a mounting plate 46. A transfer mechanism is shown generally at 48 in FIG. 4 and which is controlled to selectively engage with a second transfer mechanism 50 for selectively driving the rear wheels 32. The specifics of the engine 44, transfer mechanisms 48 and 50 and associated controls do not form a specific part of the present invention, and are not further described. It is understood that conventional drive mechanisms are well known and can be utilized. Alternatively, movement to the cart 20 may be manually provided by the operator.

At the front end of the cart 20, the frame elements 26 and 28 support a vertical box tube 52, and adjacent thereto a horizontal support place 54. The vertical box tube 52 is preferably provided to make a sturdy vertical support for a vertical guide plate 56 which is fixed with the box tube 52 to be positioned adjacent to the support plate 54. The vertical guide plate 56 could instead be directly or otherwise indirectly connected with the cart frame. Vertical guide plate 56, as shown best in FIG. 3, preferably includes a key-shaped slot 58 to define a vertical guide for a second vertical guide plate 60 which itself includes a corresponding key-shaped element 62 slidably disposed within the key slot 58. By this construction, the second guide plate 60 is vertically movable as guided by the vertical guide plate 56. One or both of the guide plates 56 and 60 are preferably removably attached so that other vertical ranges of movement can be defined.

Figure 6:
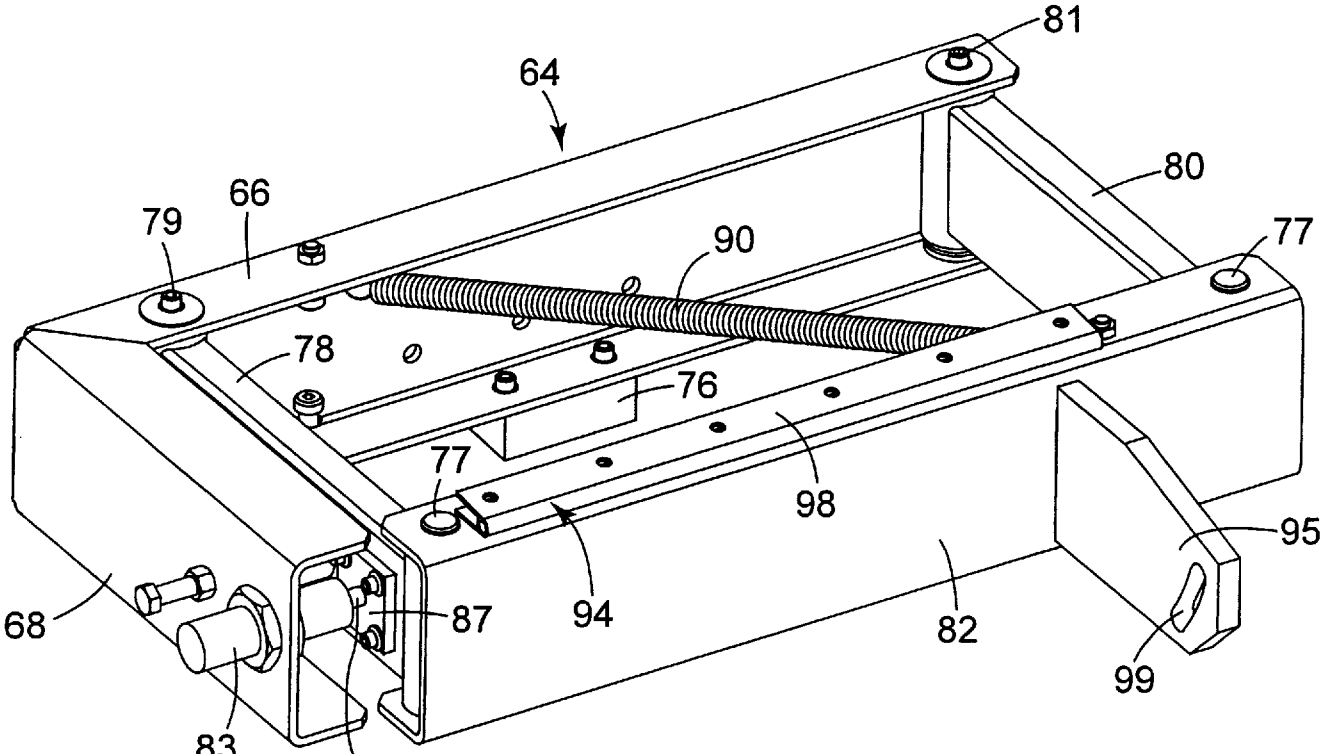
FIG. 6 is a perspective view of the horizontally movable mechanism and tilt adjustment mechanism with the taping head support plate removed.

The second vertical guide plate 60 is preferably fixed with a plate 61 so that plate 61 moves with the second vertical guide plate 60. The plate 61 is, in turn, mounted with a horizontal frame assembly 64 so as to make the horizontal frame assembly 64 also vertically movable with the second vertical guide plate 60. As shown in FIG. 6, the horizontal frame assembly 64 comprises fixed frame members 66 and 68 which are connected to one another to make an L-shaped stationary frame portion. This stationary frame portion, specifically the frame member 66, is fixed with the plate 61 of the second vertical guide plate 60 (see FIG. 2) so that the horizontal frame assembly 64 is vertically movable with guide plate 60.

In order to precisely position the horizontal frame assembly 64, a vertical adjustment mechanism 70 is operatively provided between the horizontal frame assembly 64 and the support plate 54 of the cart assembly 20. The illustrated vertically adjustment mechanism 70 comprises a conventional scissors-type jack including a threaded rod 72 which when rotated in one direction expands the conventional scissors structure 74, and when rotated in the opposite direction contracts the scissors structure 74. Such a scissors-type jack mechanism is well known. Any other conventional structure, including mechanical, hydraulic, pneumatic, electronic, and the like, mechanisms can be utilized instead as the vertical adjustment mechanism 70. The top of the scissors structure 74 is preferably connected with the horizontal frame assembly 64, preferably by way of an element 76 which is in turn preferably connected to frame member 66. The horizontal frame assembly 64 may instead simply sit on top of the vertical adjustment mechanism 70. The vertical adjustment mechanism 70 is also preferably fixed in location relative to the support plate 54.

Alternatively, the vertical adjustment mechanism 70 can be used without being combined with the guide plates 56 and 60. In this case, the vertical adjustment mechanism 70 can inherently provide directional guidance.

Figure 7:
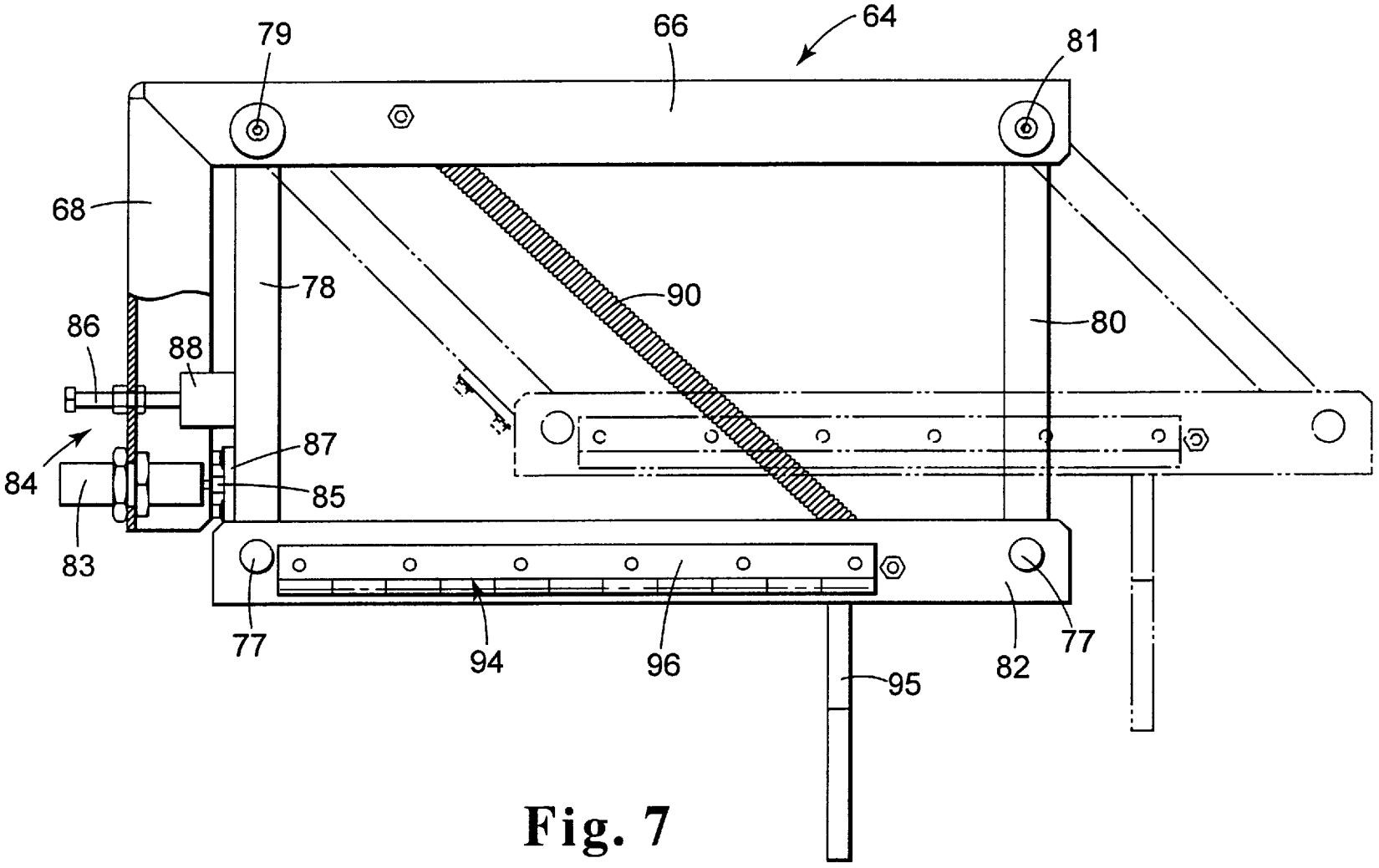
FIG. 7 is a top view of the mechanisms illustrated in FIG. 6 and partially broken away to illustrate an adjustable stop mechanism.

As shown in FIG. 7, the horizontal frame assembly 64 preferably comprises a four-bar parallel linkage mechanism which is movable between various positions illustrated, for example, in solid and in phantom. Specifically, the frame member 66 is pivotally connected with a pair of spaced links 78 and 80 having conventional pivotal connections 79 and 81. Preferably the pivotal connection 79 and 81 comprise conventional bushings to minimize wear. The spaced links 78 and 80 are preferably of similar length, arranged parallel to one another, and further connected to a movable frame member 82 by conventional pivotal connections 77. As a result, the movable frame member 82 is horizontally movable with respect to the stationary frame portion comprising frame members 66 and 68 of the horizontal frame assembly 64.

The movable frame member 82 is also preferably biased to its outermost position. Its outermost position is defined by an adjustable stop mechanism 84 which is connected with the frame member 68. As shown, the adjustable stop mechanism comprises a threaded element 86 which is fixed with a stop element 88 so that the stop element 88 can be positioned as desired by a threaded engagement between the element 86 and the frame member 68. The stop element 88 includes a surface positioned to abut against a surface of link 78, as shown. Biasing towards the outermost position can be provided by any number of tension springs. Specifically, as shown in FIGS. 6 and 7, a pair of tension springs 90 are preferably connected between frame member 66 and the movable frame member 82. The tension springs provide a relatively strong biasing force to bias the movable frame member 82 toward its outermost position defined by the stop element 88. More or less springs can be provided depending on the desirable bias force to be generated. The biasing permits the horizontal frame assembly 64 to collapse thus allowing movable frame member 82 to move closer to frame member 66 when a force is applied thereto, but urges movable frame member 82 back outward. This action is advantageous for the applying and compensating process described more fully below. Preferably, a damper device 83 is also mounted to the frame member 68, as shown, for reducing the impact of the link 78 against the stop element 88, when it is driven to that position under the generated bias force. The damper device 83 includes a movable pin portion 85 that is biased to an extended position by an internal bias means (not shown) and which is movable within the body of the damper device 83 against its internal bias. The link 78 includes a strike plate 87. The strike plate hits the extended pin portion 85 when the movable frame member 82 is moved to its outermost position. The movement of the pin portion 85 into the damper device 83 is effectively controlled to permit a more gradual movement of the movable frame member 82 near its outermost position, and thus, to lessen the impact force against the frame member 68. The damper device 83 may be controlled hydraulically, pneumatically, mechanically, electronically, or otherwise. Preferably the damper device comprises a hydraulic device, such as model no. Uni Shok 650, available from Taylor Devices Inc. of N. Tonawanda, N.Y.

By virtue of the fact that the horizontal frame assembly 64 is vertically adjustable by way of the first and second vertical guide plates 56 and 60 and as positioned by the vertical adjustment mechanism 70, it can be seen that the movable frame member 82 itself is also vertically adjustable. Thus, the movable frame member 82 can be positioned relative to the position of the cart assembly 20 in both a vertical and a horizontal direction. As to the vertical direction, the movable frame member 82 can be positioned by specifically selecting a vertically adjusted position by way of the mechanism 70, while in the horizontal direction, the movable frame member 82 is free to move as controlled by the pivotal links 78 and 80 under the bias of tension springs 90.

Figure 5:
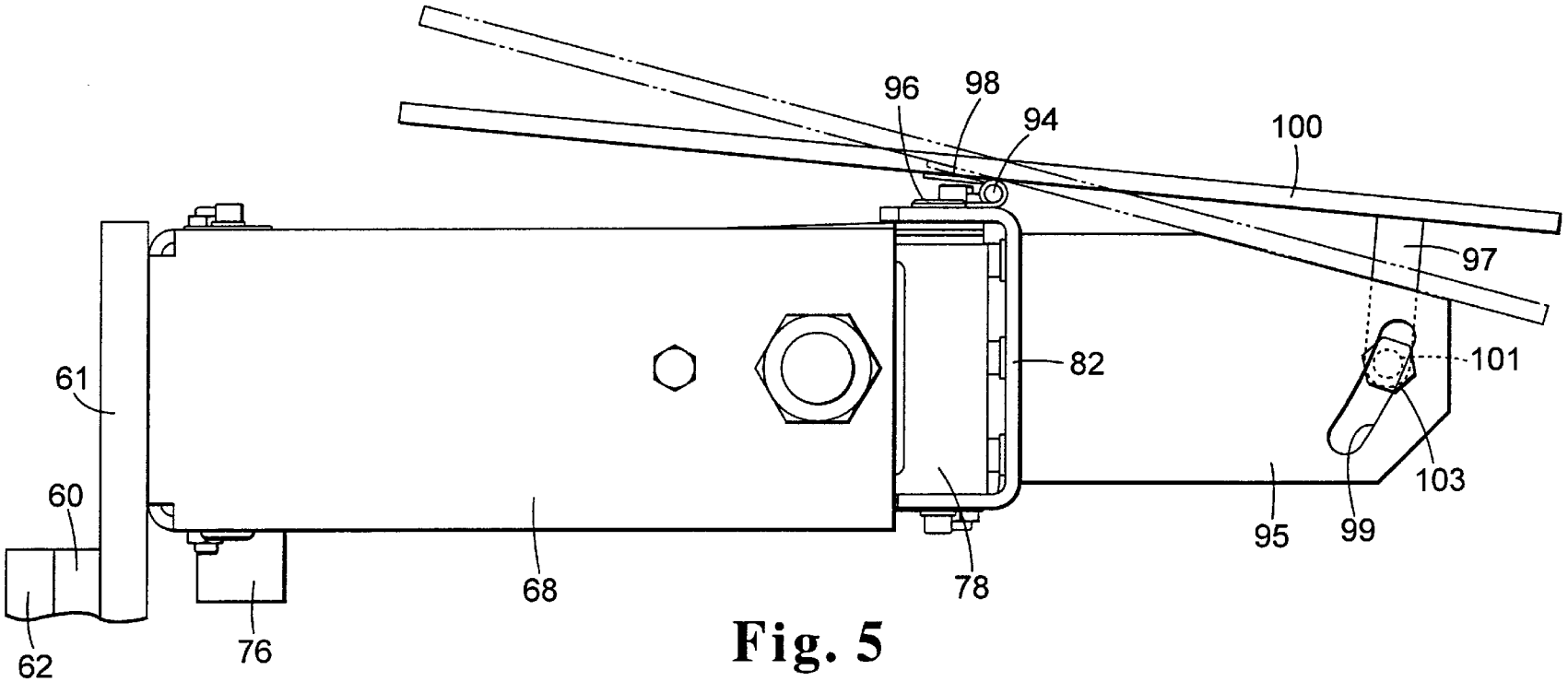
FIG. 5 is a partial front view of the apparatus in accordance with the present invention showing a horizontally movable mechanism and a tilt adjustment mechanism for positioning a support plate of the taping head.

A tilt mechanism is further provided and is preferably connected to the movable frame member 82. As shown best in FIGS. 5–7, a hinge mechanism 94 is preferably mounted to a top surface of the movable frame member 82 so as to define a hinge axis running along the top of the movable member 82 and in its longitudinal direction. The hinge mechanism 94 can comprise any conventional hinge type structure such as of the type including a first leaf 96, a second leaf 98 and a hinge pin. The first leaf 96 is shown fixed to the upper surface of the movable frame element 82. The second leaf 98 is connected to the first leaf 96 by a conventional hinge pin and the second leaf 98 is shown secured to a support plate 100 of the taping head 18. In order to lock the support plate 100 in any adjusted angular position, a lock mechanism is preferably provided including, as shown, a bracket 95 fixed with the movable frame member 82 which can be locked relative to a bracket 97 fixed with the lower side of the support plate 100. The bracket 95 includes an arcuate slot 99 (the arc defined by the hinge mechanism 94) and the bracket 97 includes a hole 101. A conventional nut and bolt assembly 103 can then be used to lock the position of the bracket 97 within the slot 99 of the bracket 95. Any adjusted angular position of the support plate 100 can thus be maintained within the range defined by the slot 99. Any other locking mechanism could instead by utilized, including mechanical devices, electrical, hydraulic, pneumatic devices, and the like. Moreover, such a device can include means for imparting movement and thus adjustment of the support plate 100. For example, a pneumatic cylinder can be controlled to expand or contract to define and set the desired angular position of the support plate 100. Furthermore, an absorbing structure can also be incorporated, like a shock absorber, so as to provide a limited range of movement of the support plate 100 even after it is set in a predetermined position. Such a feature would permit the support plate 100 to move under a force above a threshold value within a defined range.

As a result, the taping head 18, as positioned by its support plate 100, is not only vertically and horizontally movable, by virtue of the movable frame member 82, but also is angularly movable about an axis of rotation defined, in accordance with the preferred embodiment, by the hinge mechanism 94. The hinge mechanism 94 permits the support plate 100 to move in the manner illustrated by the solid and phantom positions in FIG. 5. As illustrated, the support plate 100 is movable from a substantially horizontal position to a tilted position wherein its one side can be lowered. If it were desirable to provide more angular adjustment, so that, for example, either side of the support plate 100 can move up and down about the axis of rotation defined by the hinge mechanism 94, a different hinging mechanism can be provided. For example, the second leaf 98 of the hinge mechanism 94 can be further offset from the axis of rotation defined by the hinge mechanism 94 to permit more adjustability. Various other hinging or pivoting mechanisms can be utilized in accordance with the present invention.

Figure 8:
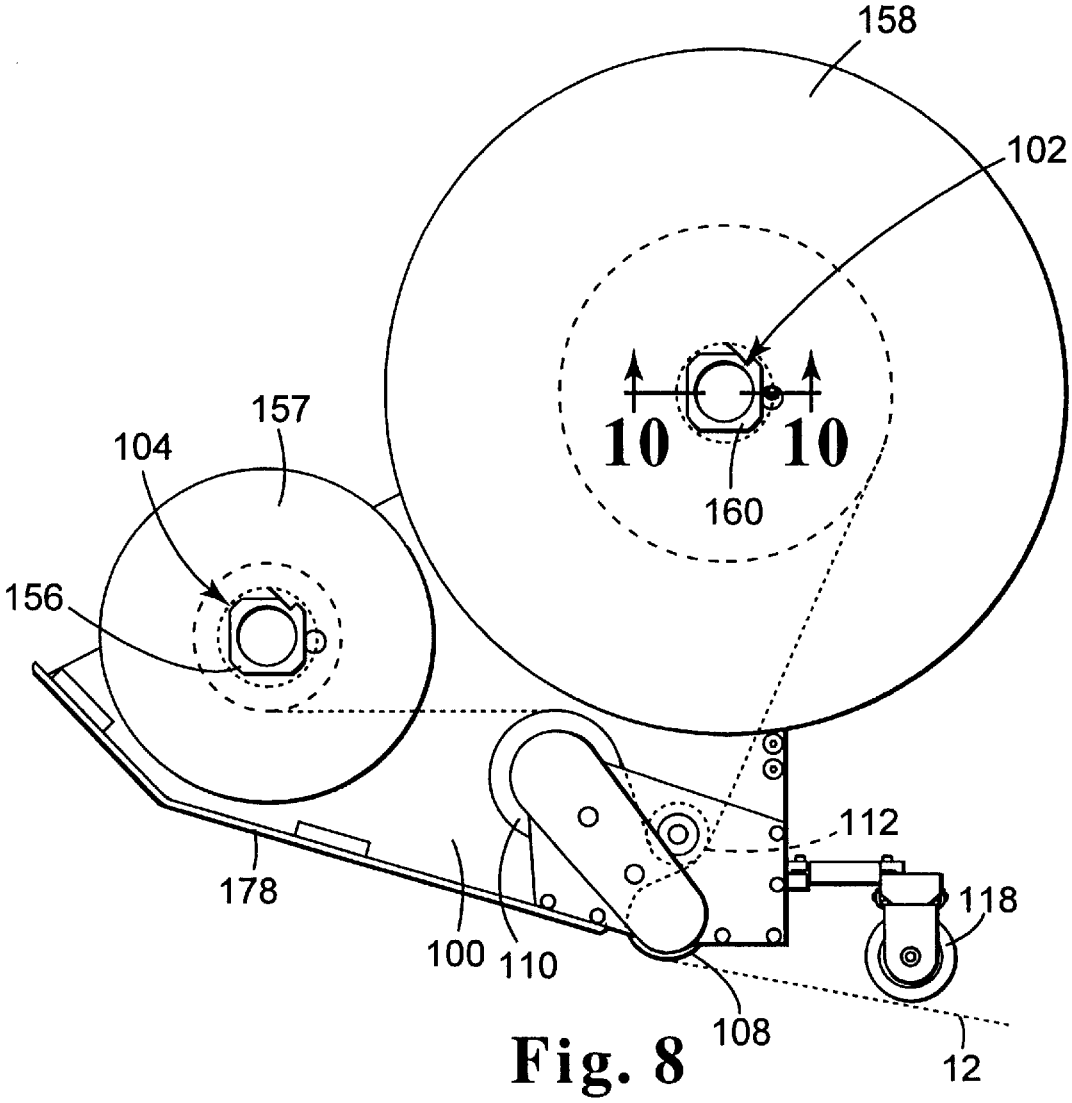
FIG. 8 is a top view of a taping head and support plate in accordance with the present invention.
Figure 9:
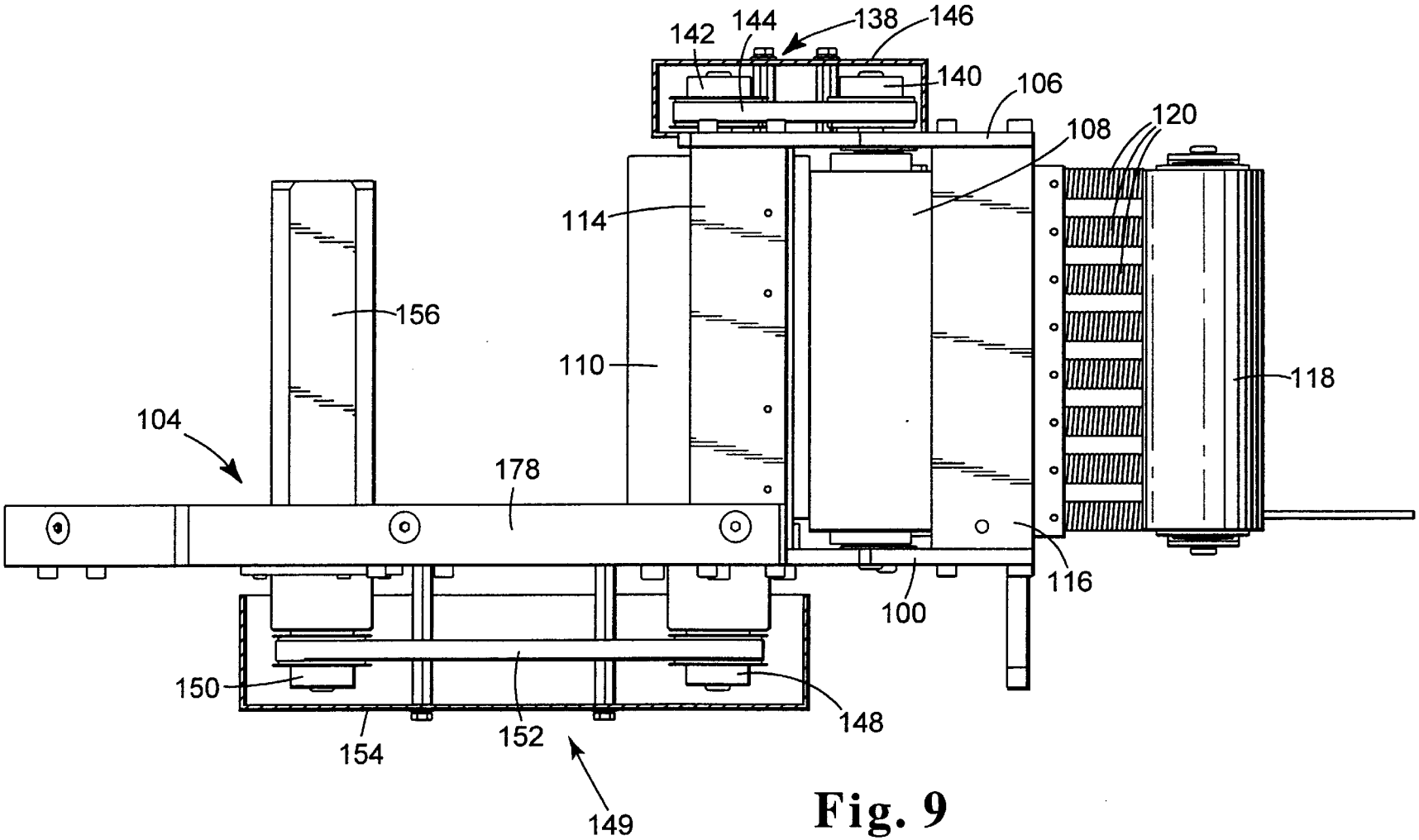
FIG. 9 is a side view of the taping head of FIG. 8, partially in cross-section, to illustrate the drive transfer mechanisms used therein.

As shown in FIGS. 8 and 9, the taping head 18 comprises the support plate 100 which supports a number of rollers and hubs which control the dispensing and applying of the adhesive tape product 12. More specifically, a tape roll support hub assembly 102 is pivotally supported by the support plate 100, as is a liner take-up hub assembly 104. Also supported between the support plate 100 and a spaced support plate 106 (see FIG. 9) are an application roller 108, a guide roller 110 and a stripper roller 112 (shown in phantom in FIG. 8 and schematically in FIG. 1). For structural integrity, a number of cross braces are provided that are fixedly connected between the spaced support plate 106 and the support plate 100 at locations adjacent to the rollers 108, 110 and 112, but without interfering with the tape and liner guide paths defined through the taping head, as illustrated in phantom and described more fully below.

Cross braces 114 and 116 are shown in FIG. 9. More or different braces may be provided if desired. A guide fence 178 is also preferably provided along the application side of the support plate 100 for shielding purposes.

Figure 11:
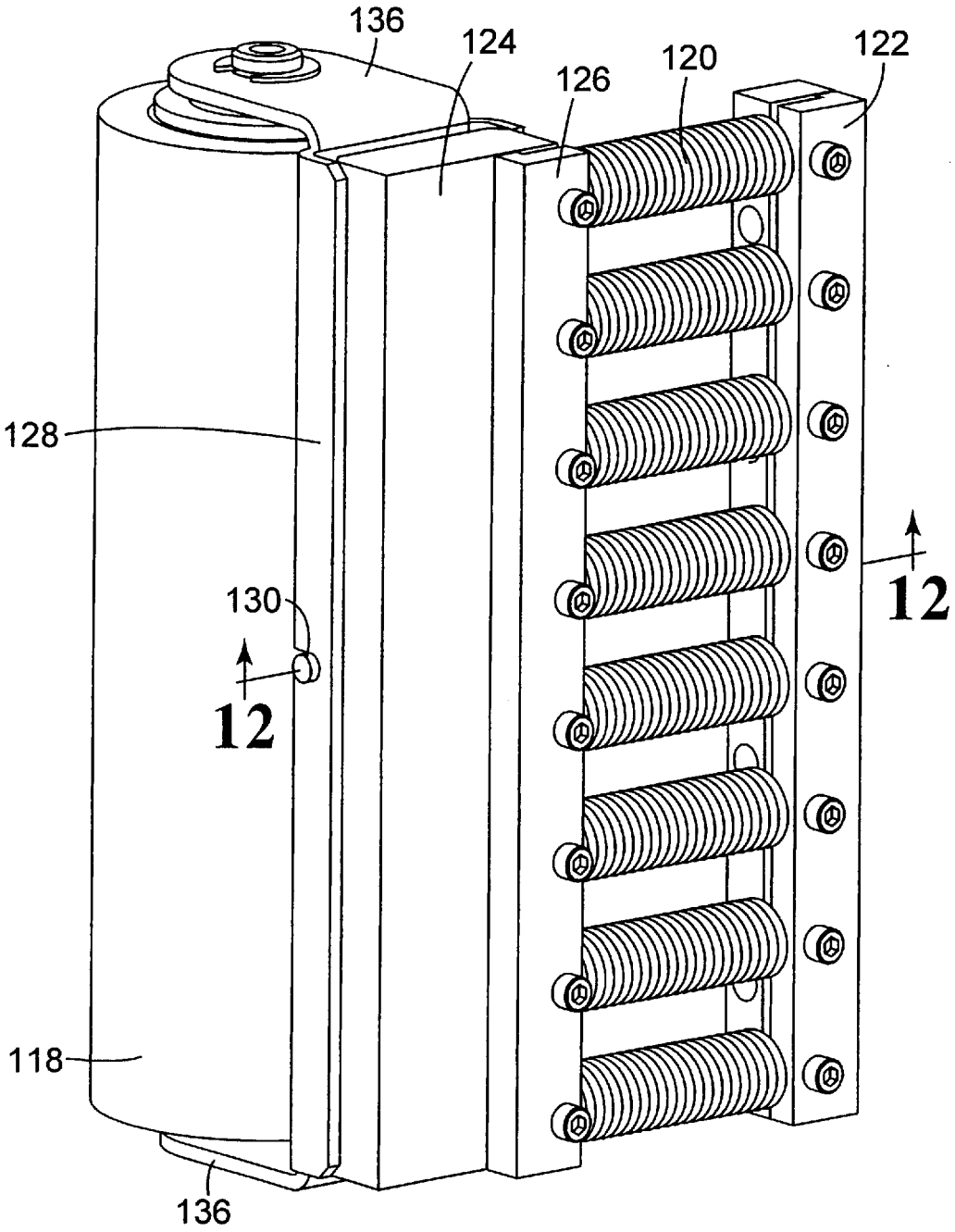
FIG. 11 is a perspective view of a tamping roller separated from the taping head of the present invention.

Also connected with the taping head 18 is a tamping roller 118. Preferably, the tamping roller 118 is connected to the structure defined by the spaced support plates 100 and 106 and cross braces 114 and 116 by way of a plurality of spring members 120. As shown in FIG. 11, the spring members 120 are connected between a connecting bar 122 and a first roller support member 124. Connecting bar 122 preferably comprises two elements connected together by a number of screws between which an end of each spring member 120 is sandwiched. In a similar sense, the other ends of the spring members 120 are preferably sandwiched between the first roller support member 124 and connecting bar 126 in a like manner. The connecting bar 122 is preferably connected between the spaced support plates 100 and 106 of the taping head by way of a cross brace (not shown) that is itself connected between the spaced support plates 100 and 106. The purpose of the plurality of spring members 120 is to function together in the sense of a leaf spring for providing a biasing force to the tamping roller 118 to apply a sufficient pressure against the adhesive tape product 12 applied as shown in phantom in FIG. 8.

Figure 12:
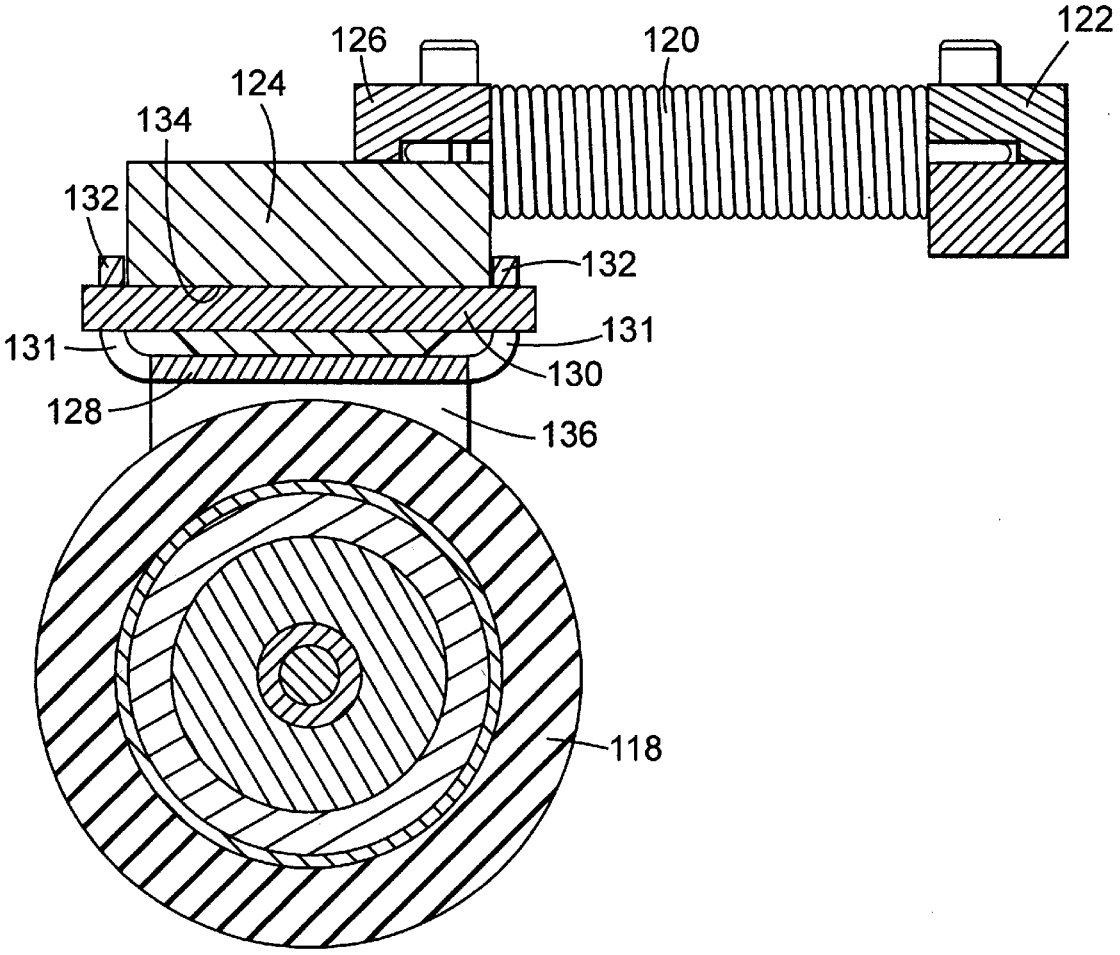
FIG. 12 is a cross-sectional view taken along line 12—12 of FIG. 11 illustrating a pivotal connection in the mounting assembly of the tamping roller to permit it to follow surface fluctuations of the applied surface.

In order to permit the tamping roller 118 to better follow surface fluctuations, the first roller support member 124 is further pivotally connected with a second roller support member 128. Specifically, as shown best in FIG. 12, a pivot pin 130 passes through openings 131 of side flange portions 132 of the second roller support member 128 and through a passage 134 provided through the first roller support member 124. The pivot pin 130 is preferably axially and rotationally fixed within passage 134 of the first roller support member 124, such as by a press-fit and/or a set screw, so that the ends thereof are freely rotatable within the openings 131 of the second roller support member 128. By this construction, the second roller support member 128 can pivot to some degree about the pivot pin 130 with respect to the first roller support member 124. The amount of pivot is defined by the clearance between the first and second roller support members 124 and 128 at the ends thereof. Also at the ends of the second roller support member 128, roller support flanges 136 are provided. The tamping roller 118 is preferably conventionally freely rotatably connected to the roller support flanges 136.

Figure 10:
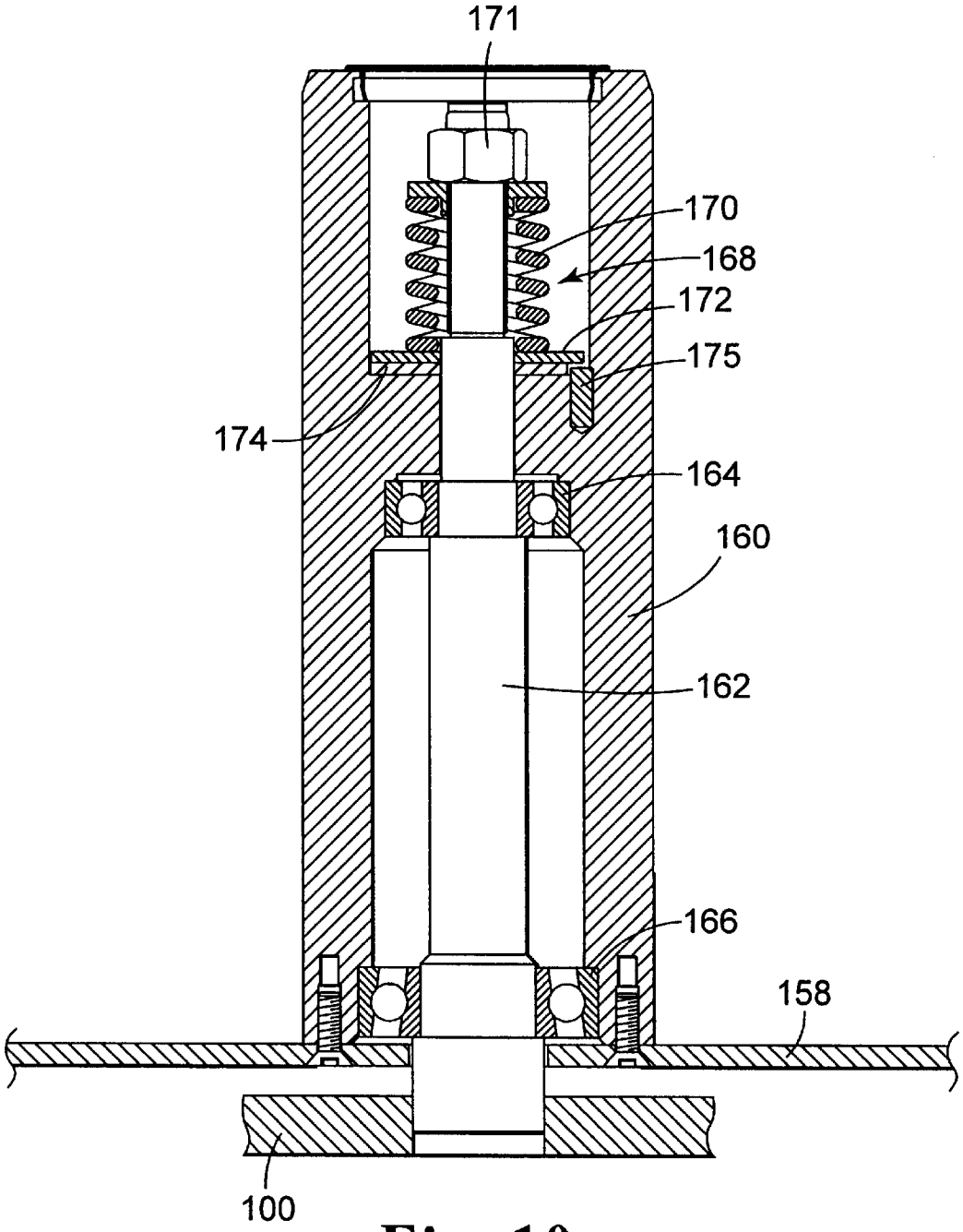
FIG. 10 is a cross-sectional view taken through line 10—10 of FIG. 8 showing the tape roll support hub assembly.

As shown in FIGS. 8 and 10, the tape roll support hub assembly 102 comprises a tape spool support disk 158 which is rotatably fixed with a tape spool support hub 160. Hub 160 is preferably sized to frictionally engage and rotate with a tape roll core. As shown in FIG. 10, the hub 160 and support disk 158 are rotatable and axially positioned on a shaft 162 by way of roller bearings 164 and 166 that sit against shoulders of the shaft 162. Shaft 162 is fixed to support plate 100. A friction drag mechanism 168 is preferably operatively provided between the shaft 162 and hub 160. Specifically, a compression spring 170 is fixed at the upper end of shaft 162 to apply a force against a clutch disk 172. The clutch disk 172 also lies against a friction washer 174 which is further held in position by a pin 175. By adjusting the nut 171 on the threaded top portion of shaft 162, the amount of force applied by the spring 170 against the clutch disk 172 can be adjusted. Accordingly, during the dispensing operation wherein the hub 160 is rotated as a result of tape being drawn from the tape roll, the friction drag mechanism 168 provides a braking force against the rotation of the hub 160.

The application roller 108, guide roller 110 and stripper roller 112 are preferably freely rotatably supported between the support plates 100 and 106 of the taping head 18. One-way clutch mechanisms may be conventionally incorporated in one or more of these rollers to limit its rotation to a single direction. As shown in FIG. 9, the application roller 108 is drivingly connected with the guide roller 110 by a drive transfer mechanism 138. Specifically, the drive transfer mechanism 138 preferably comprises a first pulley assembly 140 which is attached to a shaft of application roller 108 so as to rotate with the roller 108 and a second pulley assembly 142 connected to the shaft of and to rotate with the guide roller 110. The first and second pulley assemblies 140 and 142 are drivingly connected together by a belt 144. Thus, as the application roller 108 is rotated, the guide roller 110 is rotated. As will be further described below, the application roller 108 is driven during the tape application process, and the guide roller 110 is driven via the drive transfer mechanism 138. A housing 146 is also preferably provided for covering the drive transfer mechanism 138.

The guide roller 110 is further preferably connected with a second pulley assembly 148 at its other end as part of a second drive transfer mechanism 149. The pulley assembly 148 is further drivingly connected with a pulley assembly 150 of the liner take-up assembly 104. A belt 152 provides the drive connection between pulley assemblies 148 and 150. Again, a housing 154 is preferably provided to cover the second drive transfer mechanism 149. As a result, when the application roller 108 is driven during the application process, drive is transferred to guide roller 110 via the first drive transfer mechanism 138, and drive is transferred through the second drive transfer mechanism 149 to the pulley assembly 150 of the liner take-up assembly 104.

The liner take-up assembly 104 comprises a hub 156 which is preferably sized to frictionally engage the inner core of a take-up roll (shown in phantom) onto which liner material is to be wound. The hub 156 is connected to rotate with a support disk 157 and an internal shaft (not shown) which is rotatably supported by the support plate 100 so as to pass through the support plate 100. An end of the internal shaft is also connected to rotate with and be driven by the pulley assembly 150. It is, however, preferable that a slip drive mechanism be incorporated within this shaft drive. Specifically, the shaft (not shown) that is rotatably connected to the pulley assembly 150 is rotatably connected with the hub 156 by way of a friction clutch disk mechanism. This provides a friction drive so that the hub 156 that is provided with a core for taking up liner material can rotate more slowly than the shaft is driven by the pulley assembly 150. More slippage will occur as liner material builds up on the take-up core. The slip drive mechanism can include components substantially similar to the friction drag mechanism shown in FIG. 10. However, instead, the internal shaft 162 would be rotatable within a conventional bearing assembly supported by the support plate 100 and would extend further downward and be connected to rotate with the pulley assembly 150 (as shown in FIG. 9). Thus, as the internal shaft is rotated, drive is transferred to hub 156 via a friction clutch.

With reference to FIGS. 1 and 8, the tape guide feed path and liner take-up feed path are defined as follows. A roll of adhesive tape product is provided onto the tape spool support hub 160 and support disk 158. The tape product 12 is run to pass between the stripper roller 112 and the application roller 108. At this point, the liner of the adhesive tape product 12 is split from the tape product 12 so that the non-adhesive tape product backside is positioned against the outer surface of the application roller 108. The liner material passes around the stripper roller 112, over the guide roller 110 and onto a take-up spool supported on hub 156 and its attached support disk 157. The tape product 12, after being applied to a surface, is tamped in position by the tamping roller 118 under its bias force.

In the operation of the present invention, the apparatus 10 is moved along the primarily vertical surface to which an adhesive tape product is to be applied. The apparatus 10 can be moved under self-propulsion or otherwise. To apply the adhesive tape product 12, a leading edge of the tape product 12 having its liner portion peeled therefrom is positioned adjacent to the outer surface of the applying roller 108. The adhesive side of the adhesive tape product 12 is initially adhered to a portion of the vertical surface of the application object. Thereafter, moving the apparatus 10 causes the tape product 12 to be unwound from its supply spool and applied by the applying roller 108. The tamping roller 118 exerts a sufficient pressure to ensure good adhesion. The liner material is threaded in the manner described above and during the application process is wound upon the take-up spool. As the application roller 108 is driven during the application process, the first drive transfer mechanism 138 drives the guide roller 110, which in turn drives the second drive transfer mechanism 149 which in turn drives the hub 156 of the liner take-up assembly 104.

In accordance with the present invention, the adhesive tape product 12 can be applied at any predetermined location along a vertical surface such as the surface 14 of a series of barriers 16. First of all, the height of the application is set by the vertical adjustment mechanism 70. Then, the cart assembly 20 is positioned sufficiently near the barriers so that the application roller 108 can ride against its side surfaces 14. In this position, the movable frame member 82 can be moved inward from its outermost position against the bias of springs 90. Preferably also, the guide roller 36 rides against a lower portion of the barriers. During the application process, the movable frame member 82 of the horizontal frame assembly 64 can be moved inward, as shown in FIG. 7 against the bias of the springs 90 to follow the surface defined by the barriers. The bias of springs 90 functions to keep the application roller 108 against the sidewalls of the barriers. At the same time, the axis of rotation of the application roller 108 is preferably oriented to be substantially parallel to the surface of the sidewalls 14 of barrier 16, the orientation thereof permitted by the hinge mechanism 94, and as preferably locked in its adjusted position by brackets 95 and 97. The result is that the taping head 18 can apply adhesive tape product 12 to any primarily vertical surface for a continuous length of indefinite length up to the total length of the tape provided on a roll of adhesive tape product. Moreover, by the vertical adjustment, once a height has been selected, the adhesive tape product 12 can be applied consistently at that height level. Additionally, because of the absorbing ability of the horizontal frame assembly 64, the taping head 18 is permitted to move horizontally in and out from the primarily vertical surface. Thus, fluctuations or undulations within the surfaces, such as may be caused when a series of objects, such. as barriers are arranged end to end, can be accommodated for without further operator requirements. The hinge mechanism 94 permits the rotational axis of the application roller 108 to follow and be oriented substantially parallel with the primarily vertical surface to which the tape product 12 is to be applied. This not only assures that the tape product 12 can be applied to surfaces that are not vertical, but also ensures that tape product will be consistently and evenly applied even when the surface orientation fluctuates.

An apparatus in accordance with the present invention can also be utilized to apply discrete lengths of tape product to such primarily vertical surfaces. In this case, the operator can start and stop the applying process as desired. The tape product can be manually cut and started, or the apparatus-.can be further provided with a cutting mechanism.

It is contemplated that many other mechanisms can be utilized to provide the vertical adjustment, horizontal adjustment and angular adjustment of the taping head in accordance with the present invention. Moreover, it is contemplated that a single device or mechanism may provide more than one of these adjustment functions.

It is also contemplated that the application apparatus of the present invention can be modified to include additional features relating to other typical process steps that may need to be done in such a tape applying process. For example, in the case of applying road barrier tape to the side of a road barrier, it is usually necessary to first scrub the barrier side wall for improving adhesion. It is also usual to apply a primer to the side wall prior to the tape application. These and/or other steps can be accomplished by attaching equipment features to the movable apparatus in accordance with the present invention. A scrubbing attachment can comprises a brush and a nozzle for spraying cleaning solution. A primer applying feature may comprise a spray nozzle or roller, for example.

I claim:

1. An apparatus for applying adhesive tape product to a primarily vertical surface of an object for an indefinite length, said apparatus comprising:

a taping head from which adhesive tape product can be dispensed and applied onto a primarily vertical surface, said taping head comprising a support member, a tape supply support assembly on said support member, and an application roller rotatably connected to said support member, wherein a tape guide path is defined between said tape supply support assembly and said application roller;

a frame including means facilitating movement of the apparatus along the object to which adhesive tape product is to be applied by said taping head; and a tilt mechanism operatively connected between said frame and said taping head for permitting an axis of rotation of said application roller to be oriented in plural angular positions relative to vertical so that adhesive tape product can be dispensed and applied by said taping head to a primarily vertical surface during movement of said frame relative to the object.

2. The apparatus of claim 1, further including a movable member that is movably disposed on said frame and also operatively connected to said taping head, so that said application roller of said taping head is positionable toward or away from the primarily vertical surface of an object without moving said frame.

3. The apparatus of claim 2, wherein said tilt mechanism comprises a hinge mechanism that is mounted between said support member of said taping head and said movable member.

4. The apparatus of claim 3, wherein said movable member is further connected to said frame by a height adjustment mechanism so that said taping head can be adjusted between various positions to apply adhesive tape product at different heights of a primarily vertical surface.

5. The apparatus of claim 4, wherein said movable member comprises a part of a horizontal frame assembly operatively mounted between said height adjustment mechanism and said tilt mechanism.

6. The apparatus of claim 5, wherein said horizontal frame assembly comprises a four-bar linkage having one member fixed with said height adjustment mechanism so that the movable member can move toward and away from the object.

7. The apparatus of claim 6, further including a biasing means for urging said movable member toward an outermost position.

8. The apparatus of claim 4, wherein said height adjustment mechanism further comprises a guide system for guiding the movable member to be movable in a vertical direction.

9. The apparatus of claim 8, wherein said guide system comprises a first guide element fixed with said frame and a movable guide element connected to said movable member, and said height adjustment mechanism further comprises an expandable and contractible device positioned between said frame and said movable member.

10. The apparatus of claim 4, wherein said taping head further comprises a liner take-up hub rotatably provided on said support member for supporting a liner take-up roll; and a tamping roller connected to said taping head by a roller bias means for providing pressure to an adhesive tape product after application to a primarily vertical surface and a pivot means between said roller bias means and said tamping roller to permit a rotational axis of said tamping roller to be varied with respect to vertical; and further wherein said tape supply support assembly comprises a rotatable hub provided on said support member for supporting a tape product supply roll.

11. An apparatus for applying adhesive tape product to a primarily vertical surface of an object for an indefinite length, said apparatus comprising:

a taping head from which adhesive tape product can be dispensed and applied onto a primarily vertical surface, said taping head comprising a support member, a tape supply support assembly on said support member, and an application roller rotatably connected to said support member, wherein a tape guide path is defined between said tape supply support assembly and said application roller;

a frame including means facilitating movement of the apparatus along the object to which adhesive tape product is to be applied by said taping head; and a movable member that is movably disposed on said frame and also operatively connected to said taping head, so that said application roller of said taping head is positionable toward or away from the primarily vertical surface of an object without moving said frame.

12. The apparatus of claim 11, further including a tilt mechanism operatively connected between said frame and said taping head for permitting an axis of rotation of said application roller to be oriented in plural angular positions relative to vertical so that adhesive tape product can be dispensed and applied by said taping head to a primarily vertical surface during movement of said frame relative to the object.

13. The apparatus of claim 12, wherein said tilt mechanism comprises a hinge mechanism that is mounted between said support member of said taping head and said movable member.

14. The apparatus of claim 13, wherein said movable member is further connected to said frame by a height adjustment mechanism so that said taping head can be adjusted between various positions to apply adhesive tape product at different heights of a primarily vertical surface.

15. The apparatus of claim 14, wherein said movable member comprises a part of a horizontal frame assembly operatively mounted between said height adjustment mechanism and said tilt mechanism.

16. The apparatus of claim 15, wherein said horizontal frame assembly comprises a four-bar linkage having one member fixed with said height adjustment mechanism so that the movable member can move toward and away from the object.

17. The apparatus of claim 16, further including a biasing means for urging said movable member toward an outermost position.

18. The apparatus of claim 14, wherein said height adjustment mechanism further comprises a guide system for guiding the movable member to be movable in a vertical direction.

19. The apparatus of claim 18, wherein said guide system comprises a first guide element fixed with said frame and a movable guide element connected to said movable member, and said height adjustment mechanism further comprises an expandable and contractible device positioned between said frame and said movable member.

20. The apparatus of claim 14, wherein said taping head further comprises a liner take-up hub rotatably provided on said support member for supporting a liner take-up roll; and a tamping roller connected to said taping head by a roller bias means for providing pressure to an adhesive tape product after application to a primarily vertical surface and a pivot means between said roller bias means and said tamping roller to permit a rotational axis of said tamping roller to be varied with respect to vertical; and further wherein said tape supply support assembly comprises a rotatable hub provided on said support member for supporting a tape product supply roll.

* * * * *